United States Patent [19]

Calderon

[11] 3,972,780

[45] Aug. 3, 1976

[54] POLLUTION CONTROL OF COKE OVENS

[76] Inventor: Albert Calderon, 1065 Melrose Drive, Bowling Green, Ohio 43402

[22] Filed: June 14, 1974

[21] Appl. No.: 479,461

Related U.S. Application Data

[63] Continuation of Ser. No. 308,703, Nov. 22, 1972, abandoned, which is a continuation-in-part of Ser. No. 283,427, Aug. 24, 1972, abandoned.

[52] U.S. Cl. ..... 201/39; 202/263; 202/227

[51] Int. Cl.[2] ..... C10B 57/12

[58] Field of Search ..... 202/262, 263, 227–230; 201/39, 40; 98/115 UM

[56] References Cited

UNITED STATES PATENTS

| | | | |
|---|---|---|---|
| 3,367,844 | 2/1968 | Cremer | 202/227 |
| 3,547,782 | 12/1970 | Schon | 202/263 |
| 3,721,609 | 3/1973 | Spendiler | 202/263 |
| 3,746,626 | 7/1973 | Morrison | 202/263 |
| 3,766,018 | 10/1973 | Riechert | 202/227 |
| 3,809,619 | 5/1974 | Drebes et al. | 201/39 |

FOREIGN PATENTS OR APPLICATIONS

| | | | |
|---|---|---|---|
| 2,038,729 | 8/1970 | Germany | 201/39 |
| 18,110 | 12/1908 | United Kingdom | 202/227 |

*Primary Examiner*—Norman Yudkoff
*Assistant Examiner*—Hiram H. Bernstein

[57] ABSTRACT

An improved method and apparatus for by-product coke oven operation wherein the problems of pollution caused by charging, oxidation of the coke during pushing, transportation of the incandescent coke to a quenching tower and quenching of the coke is eliminated by the evacuation of the gases during charging, by quenching the coke in a closed system during the push so that the temperature of the coke leaving the guide is below its ignition point; the combustion gases created by the charging and the steam and gases generated by the quenching are extracted and cleaned in a centralized dust collection system. The coke being quenched in a sealed system to a temperature lower than its ignition point, eliminates the oxidation thereof and the efficiency of the oven is increased by being able to push in shorter schedules as the necessity for extra coking time now taken to insure that all the green coke is coked, is obviated. The instant improved method comprises reliable equipment with minimum manpower for operation and maintenance. This equipment makes possible the adoption with very minor changes to present facilities and with practically no down time for the adoption thereof. Further it makes possible the use of contaminated water which nowadays presents a major problem of disposal and also the treatment of the gases from the flues.

23 Claims, 12 Drawing Figures

DUCT
I.D.

POLLUTION CONTROL OF COKE OVENS

This is a continuation of application Ser. No. 308,703 filed Nov. 22, 1972 and now abandoned, which is a continuation-in-part of application Ser. No. 283,427 filed Aug. 24, 1972, and now abandoned.

The present invention relates to an improved by-product oven of the type commonly used for the commercial production of coke.

In the art of making coke in a by-product oven, which is one of many ovens situated side by side in battery form, the coal is charged by means of a charging car through apertures or holes in the roof and the coal is heated indirectly be means of heated refractory walls which in turn are heated by the burning of fuel. During the baking of the coal or the "coking" which lasts about seventeen hours, by-product gases evolving from the coal leave the oven by means of an ascension pipe which delivers these gases into a collecting main which connects the battery of ovens to the by-product coke plant where these gases which are rich in chemicals, are processed. The battery of ovens has two sides to it, the pusher side and the coke side and each oven has two doors, one on the pusher side and one on the coke side. The pusher-machine which is not shown and which is not part of this invention, is located on the pusher side and runs on rails; it is equipped with means to level the coal during charging, take off the door of the oven, push the coke through the oven to the coke side after the coking cycle and put the door back on the oven after the push. The coke-guide door-machine which is located on the coke side also runs on rails and is equipped to take off the door of the oven, align a guide means with the opening of the oven to be pushed and put the door back on the oven after the push. A quenching car receives the incandescent coke from the guide means which car is then propelled by an engine to a tower where the coke is quenched for about 90 seconds with about 8000 gallons of water to drown the coke and drop the temperature thereof; thence the coke is transported to a wharf where the quenching car discharges it for inspection and delivery to the screening and storage area of the blast furnace department. During the charging of the coke, the removal of the doors, the pushing of the incandescent coke and the quenching thereof a very serious problem of pollution is created. Further there is a pollution problem created by the combustion of the coke oven gas in the flues of the oven and the leakage of gases from the oven chambers into the flues which gases are ejected out of the stack of the battery. The present technology is such that there are several disadvantages from the standpoint of health to the environment, difficult operating conditions and detrimental economic considerations. Becuase of the hot, dirty and simply miserable working conditions, good operations are hampered and good quality of manpower refuses to accept such occupation.

This inventor has done a great deal of experimental work in actual operating ovens to eliminate the noxious gases prevalent all over the area of coke making including on top the battery where breathing masks must be worn. The inventor developed a centralized gas cleaning plant adapted to evacuate and treat gases during charging, during the extraction of oven doors, during pushing, and during quenching, the same gas cleaning plant being also adapted to treat the gases from the flues after these gases are fully burned in an afterburner.

The oxidation of the coke at the push but particularly the extra length of time required to coke the cold ends of the oven in order to minimize green coke during the push, causes the yield per oven to drop. There is a lot of pressure from Health Boards to lengthen the coking cycle to make sure that a minimum amount of green coke leaves the oven; whereas if the green coke were of no concern by preventing the oxidation thereof in quenching it as it leaves the oven, the oven can be pushed at a much shorter schedule increasing productivity and reducing costs in the form of saving of manpower, fuel, ammortization of equipment, etc. It is predicted that this country will be needing a lot more coke in the years to come, increased productivity with the provision of clean environment is of utmost priority, and this is what the instant invention is concerned with.

Attempts are being made to solve the above mentioned problems such as the collecting hood installed at Ford Motor Company, Dearborn, Michigan, to collect fumes during the push but at best this can only solve the pollution problem during the push. Such hood is not capable to solve the problem of pushing green coke which is very common in many pushes. The AISI in cooperation with Jones & Laughlin, Pittsburgh, devised a system for smokeless charging by ejecting steam in the stand pipes to create a negative draft in the oven and thus aspirate the smoke into the collecting main. As of now this has not been a successful installation because the limitations of a single main which most batteries in this country possess, the pulling of coal dust into the main, the fighting of the positive pressure in the main and tar deposits occurring during coking presenting problems to the steam ejection system. The AISI installation is again limited to charging only. An installation at Weirton, West Virginia contemplates the collection of gases during the push and the quench but this installation is very massive and requires great changes to present facilities including very high investment costs. This system again is limited to the push and the quench. Other schemes are being proposed such as dry quenching in a complete and separate refractory lined retort currently used in Russia and some countries in Europe. This system was mainly developed for heat recovery and still has the limitation of smoking during the push of green coke and has no provision to take care of the charging problem. Another is quenching in the car after the push using a trailer with water wherein the excess water is recirculated. Here again no provision is made for the handling of the excessive smoke caused by green coke and no provision is provided to take care of the gases during charging. It is questionable whether a gas cleaning plant big enough to handle the steam and gases during quenching can be mounted on a moveable trailer. Pipe line charging is being installed by some companies but this system is limited to taking care of gases during charging but not emissions during the push and the quench. Some other schemes are proposed in Europe such as pushing the incandescent coke into a skip-bucket design with a hood and then dumping the contents of this skip-bucket into a rotary drum in which quenching will take place. This system again will only be limited to the push and the quench but not to take care of emissions caused by charging, pushing, quenching and stack emissions from the flues in one single solution.

With the above factors in view the instant invention will provide one composite solution which can easily be installed in existing facilities and which is described in detail hereinafter that will solve all the above mentioned pollution problems in the order in which they occur:

i. Pollution during charging
ii. Smoke from the green coke during door removal
iii. Smoke during the push
iv. Gas and particle evolution during the quench
v. The treatment of gases from the flues To solve the above mentioned problems the present invention proposes an improved method and apparatus than that disclosed in the aforementioned application for the improvement of the now commercial by-product coke oven operation and it is therefore the main object of this invention to provide the following:

a. A centralized dust collection system which is stationary and of adequate size equipped with a gas cleaning scrubber, a main duct leading to all the ovens of the battery with aperture means for staying connected, and a fan to insure the putting of any particular oven to be evacuated in a negative draft.
b. A secondary door on each oven door of every oven on the coke side similar to the leveling door on the pusher side through which charging gases are evacuated.
c. An apparatus having in combination, an evacuator as well as quencher, adapted to travel on wheels on the coke side which apparatus makes connection in a sealed fashion to said main duct in such a manner that the connection to the duct remains fixed despite the traveling motion of the apparatus. This apparatus possesses three main components:
   1. A fume evacuator to extract fumes during charging from said secondary door disposed to the oven door on the coke side.
   2. A door extracting mechanism of conventional design.
   3. A quenching guide enveloped by a chamber adapted to quench the coke during the push.

These main components are mounted on a carriage for movement from oven to oven along the entire battery.

d. Along the length of the battery a water distribution system is provided to make possible the availability of water for said apparatus.
e. Provisions are made on said apparatus to evacuate gases during the door removal on the coke side prior to the push.
f. Gases from the flues are diverted to said main duct after being fully burned in an afterburner for treatment in said centralized dust collection system instead of ejecting said gases into the atmosphere by the conventional battery stock.

With the provision of the novel steps and the means labeled above, pollution control of smoke, fumes, gases and steam will be made possible in order to render the production of coke non-injurous to the health of the workers as well as the environment.

Another object of the present invention is to provide equipment that is not complex and which can be made reliable with respect to maintenance and accessibility and at the same time costing less than any other system proposed.

Further another important object of this invention is to provide a system that requires no changes to existing facilities except for the addition of secondary doors on the coke side for evacuation during charging, and the installation of conveyor means above ground to replace the quenching car. With these minimum changes it is possible to make the installation with practically no interruption of operations.

Yet it is another object of this invention to increase productivity by eliminating the problem created by green coke which is small in percentage.

It is still another object of the present invention to make better use of existing manpower and also eliminate several men by doing away with the quenching car, the wharf and the quenching tower.

Further still another object of the present invention is to make possible the use of contaminated water by impinging the contaminated water on incandescent coke to break up the ammonia, the organic compounds and the hydrogen sulfide to their basic elements.

Further yet another object of this invention is to avoid contamination of gases in the by-product collecting main or mains by diverting all gases other than the gases during coking to said centralized dust collection system.

It is further yet the object of this invention to eliminate cross pollution from water to air and from air to water by virtue of making the sytem closed.

Therefore another object of this invention is to provide a system that is operative on batteries having single mains, this being a very important factor because most of the batteries in the country have single mains.

It is therefore another object of the instant invention to provide a system that is operative with no interference with the operation of the by-product plant.

Therefore yet another object of the invention is to make possible the provision of better moisture control and less breakage of coke.

It is therefore yet another object of the invention to eliminate the possibility of tar deposits on the operating equipment since the equipment is independent of the coking cycle.

Also another very important object of this invention is to provide a system that will pass health standards with respect to employees' working conditions.

Other objects of this invention will appear from the following detailed description and appended claims. Reference is made to the accompanying drawings forming a part of this specification wherein like reference characters designate corresponding parts in the various views.

Before explaining in detail the present invention it is to to the details of construction and arrangement of the parts illustrated in the accompanying drawings since the invention is capable of other embodiment. Also, it is to be understood that the phraseology or terminology employed herein is for the purpose of description and not limitation.

Figure 1:
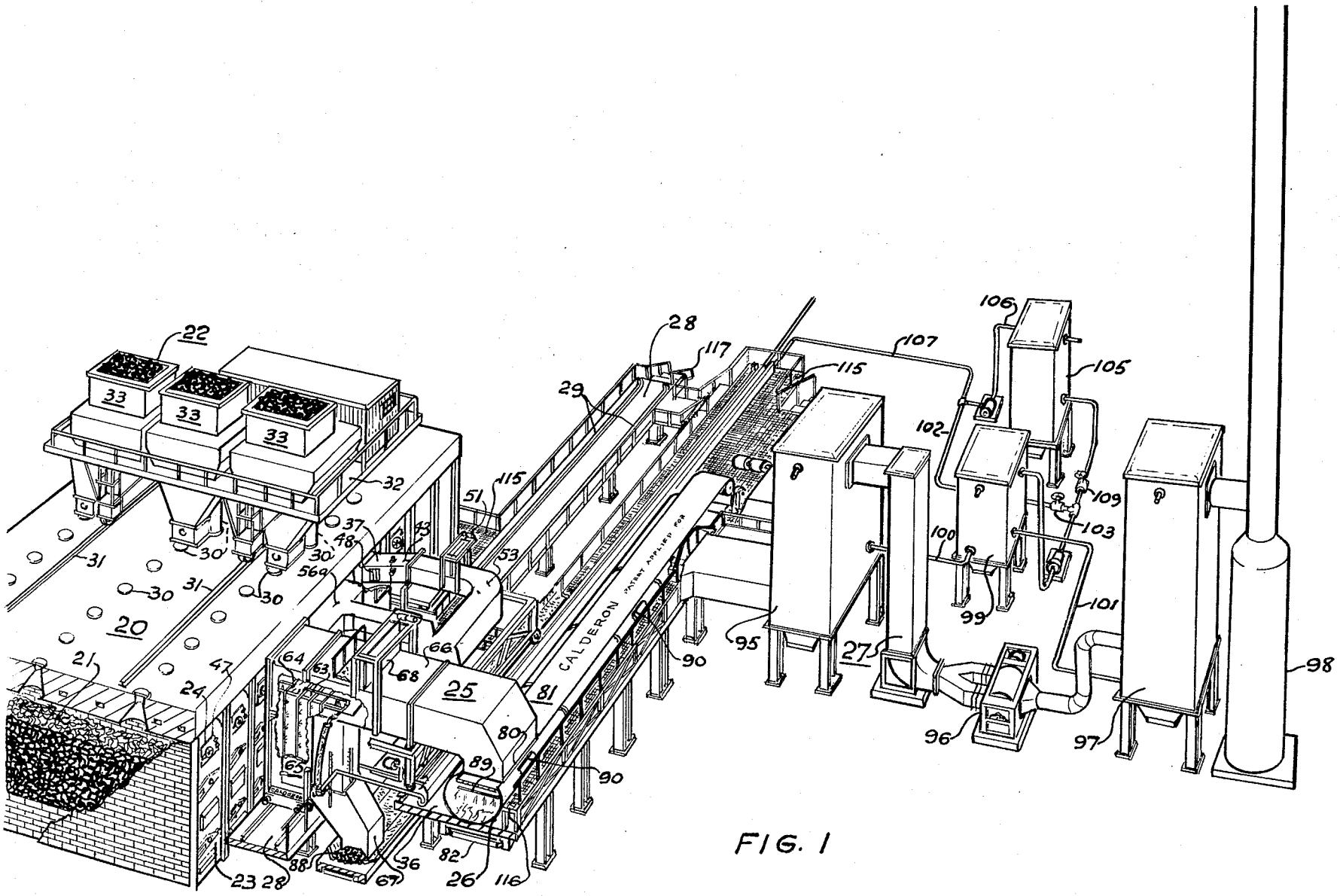
FIG. 1 is a pictorial view of the system showing the battery in section, the charging car on top of the battery, the doors on the coke side having secondary apertures, the combined apparatus to evacuate the gases during charging and to quench the coke during the push, the main duct with a provision of making a fixed connection by said apparatus to said duct, the centralized dust collection system and the water distribution system.

In FIG. 1 reference numeral 20 indicates the battery as seen from the coke side, the coke side being the side to which direction the coke is pushed after the coking cycle is completed, and 21 is generally one oven of a plurality of ovens of the battery; 22 is the coal charging car and 23 is an oven door on the coke side. Door 23 possesses aperture 24 used for evacuation of gases during charging which aperture is closed by closure 47. Aperture 24 is novel as currently door 23 on the coke side has not such opening nor closure therefor.

Evacuator-quencher 25 is the apparatus that makes connection to over 21 for evacuation and for quenching. Duct 26 which in turn ties to dust collection system 27, is the intermediate means to which gases are directed from evacuator-quencher 25 at any point along the length of battery 20. Platform or bench 28 with rails 29 is provided on the coke side of battery 20 for evacuator-quencher 25 to travel thereon.

Oven 21 and charging car 22 are known in the art and do not form part of this invention and therefore, their description need not be elaborate. Oven 21 is a rectangular slot averaging 16" wide on the pusher side and 18" wide on the coke side. The length of the oven is about 42 feet and can be of various heights depending upon capacity but averaging between 12 and 20 feet in height. Oven 21 which has brick walls on each side thereof is covered at the ends by doors such as door 23 on both the pusher side (not shown) as well as the coke side. Door 23 on the pusher side has a secondary door for leveling the charge. Oven 21 also possesses a plurality of charging apertures 30 in the roof thereof through which coal is charged. Charging car 22 which is adapted to run on rails 31 possesses structure 32 in which coal hoppers 33 are mounted.

Evacuator-quencher 25 which will be described in detail hereinafter and shown by FIGS. 2, 3, 4, 5, and 6 possesses traveling carriage 34 with supporting superstructure 54 elevating therefrom to preferably form a portal arrangement design. Carriage 34 is adapted to travel on rails 29 which are disposed on bench 28 and on rail 35 which is disposed to supporting structure 35 which structure also serves to support duct 26. As clearly shown by FIG. 6, evacuator-quencher 25 comprises mainly, evacuator 37, door extractor 38, quencher 39 and operator's cab 40. Travel drives 41 propel evacuator-quencher 25 on track wheels 42 to make possible the servicing of all the ovens of battery 20.

Figure 4:
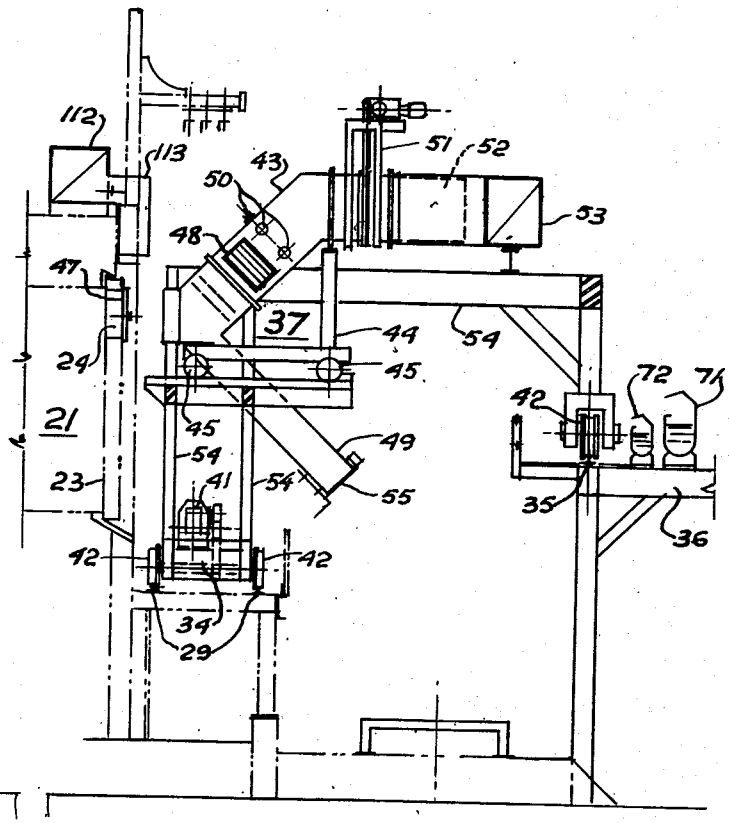
FIG. 4 is a view taken at 4—4 of FIG. 2 showing in elevation, the evacuation portion of the apparatus which serves to evacuate the gases during charging by putting the oven in a negative draft.
Figures 5, 6, 12:
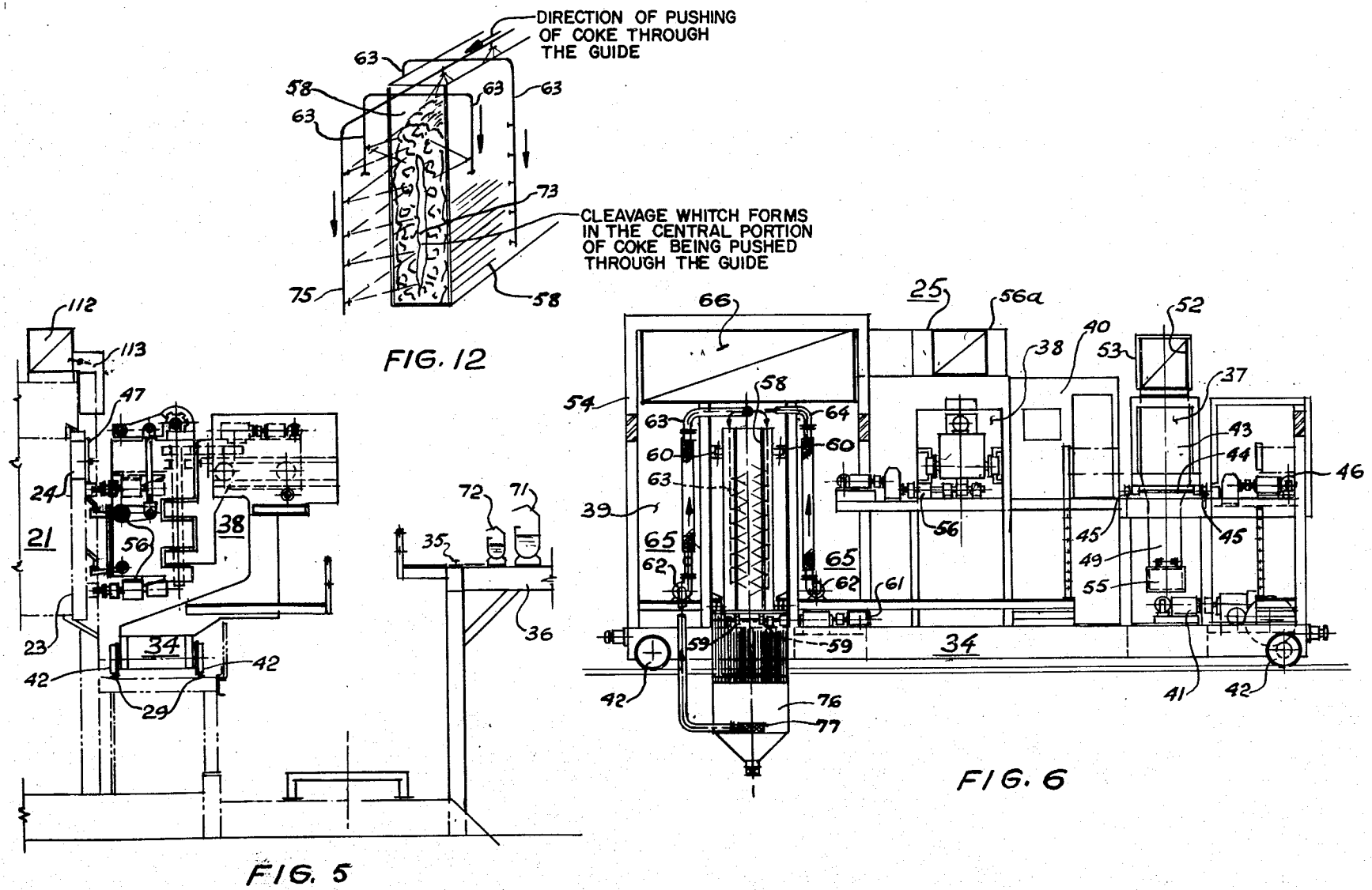
FIG. 5 is a cross sectional view of 5—5 of FIG. 2. It shows the door extracting portion of the apparatus.
FIG. 6 is a longitudinal cross sectional view taken at 6—6 of FIG. 2. It shows the combined apparatus demonstrating the gas evacuation portion, the door extracting portion, the quenching guide portion, the cab for the operator and the miscellaneous drives and pumps.
FIG. 12 is a diagramatical representation of the body of coke being quenched from the end of the guide before falling off.

As shown by FIGS. 4 and 6, evacuator 37 in turn possesses manifold 43 which is attached to transverse carriage 44 and travels on track wheels 45. This transverse carriage is propelled by drive 46 to move manifold 43 to and from aperture 24 of oven 21 after closure 47 is swung open. Manifold 43 is provided with air louvers 48, coal reclamation chute 49, ignitors 50, damper 51, telescoping extension 52 and combustion gas diverter 53. Louvers 48 serve to introduce air into manifold 43 for proper combustion with ignitors 50 sparking the mixture of gases and air. Gate 55 is provided to chute 49 for discharging coal fines sucked while evacuating emissions during charging. Damper 51 controls flow of gases.

Referring to FIGS. 5 and 6, door extractor 38 is of conventional design and is equipped with mechanism 56 to take door 23 off oven 21, hold it until the oven is pushed and put door 23 back on oven 21 after the push. Hood 56*a* is disposed over door extractor 38 to collect the gases when door 23 is removed from oven 21. Damper 57 shown on FIG. 2 controls the draft of hood 56*a*.

Figure 3:
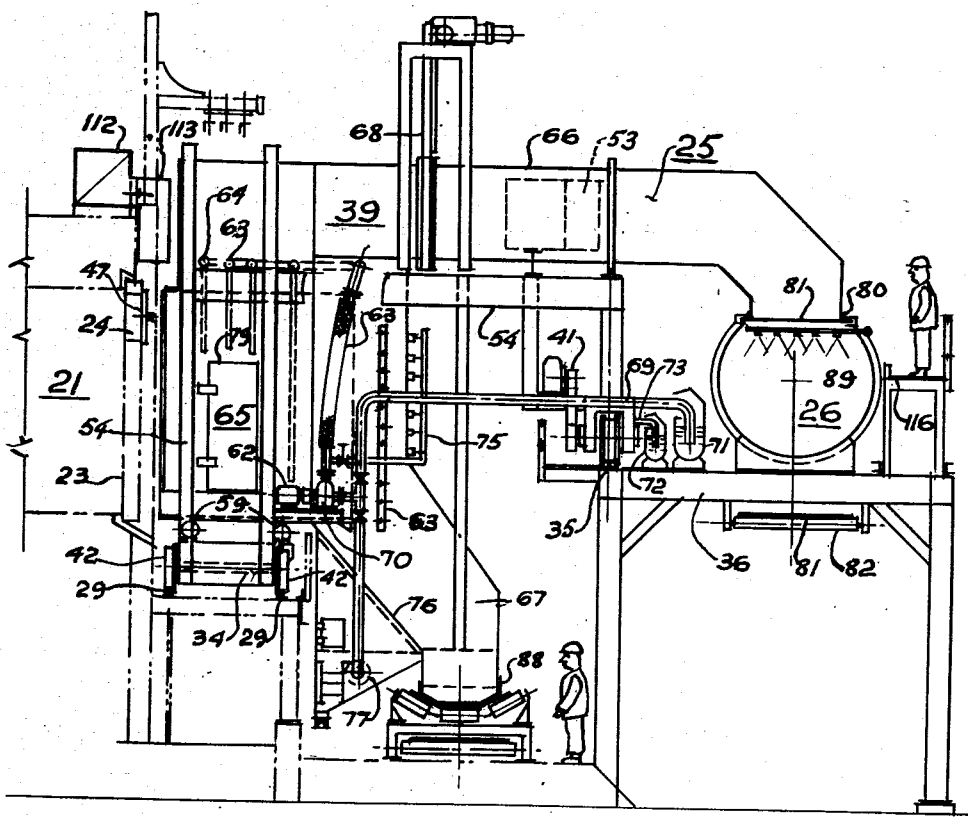
FIG. 3 is a section taken at 3—3 of FIG. 2 showing an elevation of the apparatus as connected to said duct.

Quencher 39 shown by FIGS. 3 and 6, comprises quide 58 which is adapted to travel transversely on bottom rollers 59; it is guided sideways by rollers 60. Drive 61 is used to propel guide to and from the oven door-frame after door 23 is extracted. Guide 58 is equipped with spraying system 62 to quench the coke while it is being pushed. Water distribution system 62 is provided and preferably such system is divided into two portions; one to handle clean water as shown by piping 63, and one to handle contaminated water as shown Chamber 65 which envelopes guide 58 comprises plenum 66 and discharge chute 67 with damper 68 serving to control the draft therein. Chamber 65 including said plenum and chute are rigidly built to form a unitized construction so that such unitized construction becomes an integral part of carriage 34 and move therewith. Plenum 66 makes connection with duct 26 in a special manner to be described in detail hereinafter.

Figures 2, 7, 8, 9, 10, 11:
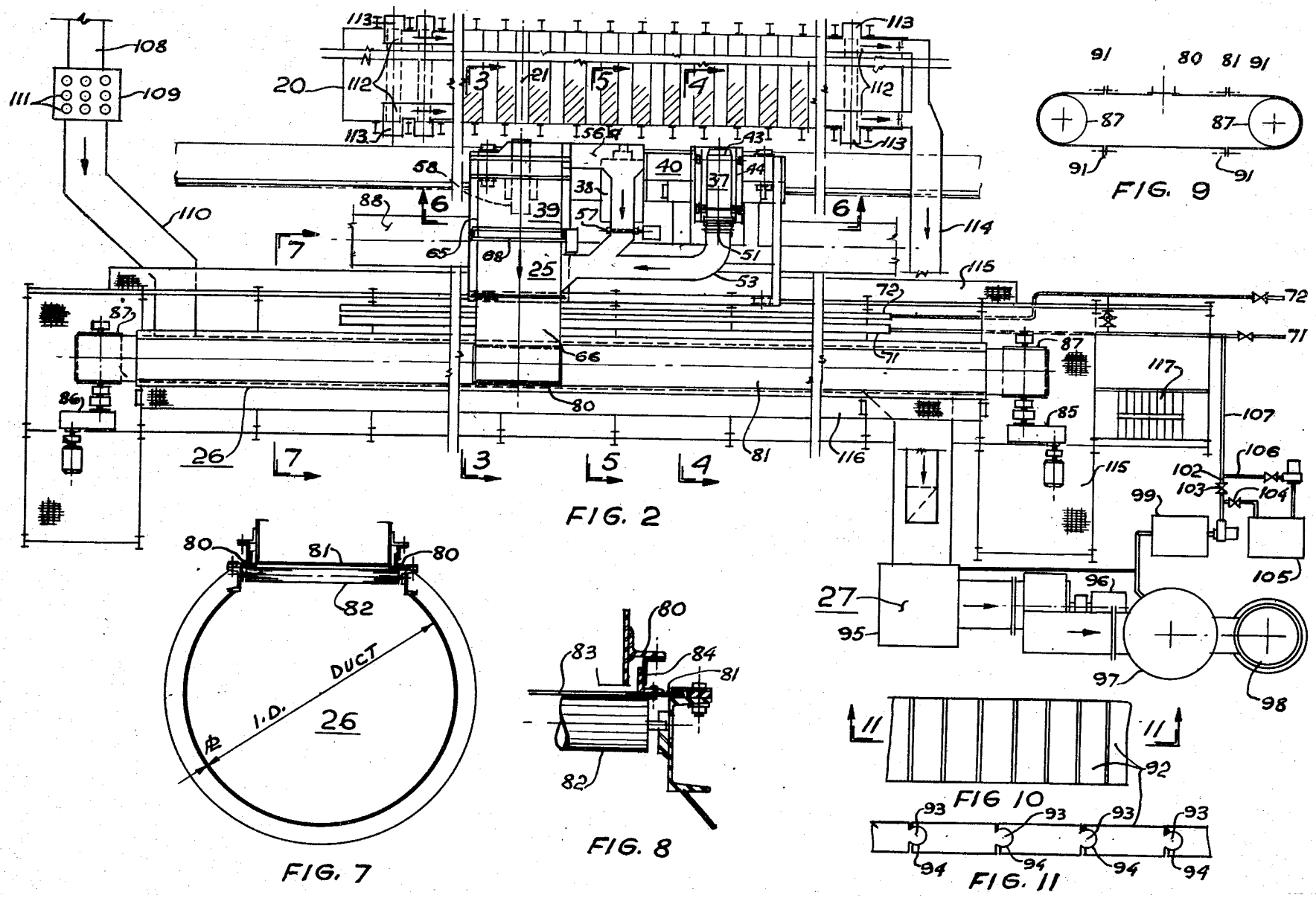
FIG. 2 is a top view showing the battery in part, the apparatus to evacuate gases and steam, the main duct to which said apparatus makes a fixed connection, the centralized dust collection system and the water distribution system.
FIG. 7 is a cross section of the main duct taken at 7—7 of FIG. 2. It shows the duct equipment with a conveyor to which the plenum of said apparatus makes connection. The conveyor is in the form of a belt which is adapted to move in unison with said apparatus.
FIG. 8 is a detailed and blown-up representation of the connection, seal of said plenum, belt and duct.
FIG. 9 is a diagramatical representation showing the belt to cover said duct with the provision of making it in sections.
FIG. 10 is a plan view of a link arrangement that can be used instead of the belt shown by FIGS. 1, 2, 3, 7, 8, and 9.
FIG. 11 is a view taken at 11—11 of FIG. 10 showing the links sectionally.

As shown by FIGS. 1, 2, and 3 quencher 39 possesses snorkel means 69 which is equipped with pumping mechanism 70 to suck water from trough 71 which trough runs along the whole length of battery 20 in order to obviate the necessity of carrying water on evacuator-quencher 25. In the handling of contaminated water trough 72 is added, preferably parallel to trough 71, wherefrom snorkel 73 sucks its water supply and it delivers to the spraying system for the consumption of contaminated water. It is preferred to have spraying means along sides, top and end of guide 58 to extensively distribute the water and attain the maximum surface exposure in order to make possible the dropping of the temperature of the coke below its ignition point in the most efficient manner. Particularly, it is preferred to also quench the coke from the emerging end where cleavage 74 occurs as shown by FIG. 12; powerful water jets are provided in spraying section 75 to insure quenching just before the coke drops into chute 67 and thence to conveyor 38. Chute 67 possesses sliding bottom 76 in the form of a grate to permit the collection of excess water in sump 77. Pump 70 is capable of withdrawing such excess water from sump 77 and discharging it into trough 71 or 72 for further re-use.

Since coke leaving the oven is incondescent and averaging about 1800°, contaminated water spray system 78 is located close to the oven door in order to incinerate and break up the contaminants in the water to basic elements. Maintenance door 79 is provided to chamber 65. Hood 56 and diverter 53 connect to plenum 66 beyond damper 68.

Inasmuch as evacuator-quencher runs from oven to oven of Battery 20, duct 26 and plenum 66 make connection at junction 80. To eliminate connecting and disconnecting plenum 66 to duct 26 everytime evacuator-quencher travels to perform a function, a cover is provided to duct 26 preferably on top of said duct and in the form of belt or band 81. Plenum 66 makes a fixed connection to band 81 at junction 80 with the provision that when evacuator-quencher 25 travels along rails 29 and 35, band 81 moves simultaneously with evacuator-quencher 25 and in the same direction and at the same speed. Duct 26 may assume a tubular shape possessing an opening along the length thereof with band 81 being an endless belt like a conveyor supported on rollers such as rollers 82. Opening 83 in band 81 is provided for plenum 66 to discharge the waste gases and steam into duct 26 at junction 80. Seal 84 made of a flexible material such as rubber is also provided at junction 80 to minimize air infiltration as shown by FIG. 8.

Referring to FIG. 2, drive 85 is provided at one end of duct 26 and drive 86 is provided at the other end of duct 26. These drives which are equipped with drums 87 keep band 81 taunt which at the same time covers the top of duct 26. Both drives 85 and 86 are electrically connected with drive 41 of evacuator-quencher 25 and the controls of drives 85 and 86 being in cab 40. The electrical control connection is such that when evacuator-quencher 25 moves to the left of FIG. 2 drums 87 are driven in a counter-clockwise direction whereas when evacuator-quencher 25 moves to the right of FIG. 2 drums 87 turn in a clockwise direction. The linear speed of band 81 is the same as the traveling speed of evacuator-quencher 25. In this manner plenum 66 remains in the same fixed position on band 81 at junction 80 irrespective of the location of evacuator-quencher 25 with respect of the specific oven to be serviced along battery 20. This is thus accomplished without breaking connection between plenum 66 and band 81. Duct 26 also serves as a condensation chamber with sprays 89 mounted therein to drop the temperature of gases and settle heavy particles. Maintenance access doors 90 in FIG. 1 are provided to duct 26 for accessibility and clean up.

It is to be understood that duct 26 can be covered by any one of several designs to substitute band 81, and by way of example FIG. 9 shows band 81 made up of a plurality of sections bolted together to make an endless band assembly, these sections being bolted in a flanged manner such as connection 91. Another arrangement is shown by FIGS. 10 and 11 comprising a plurality of longitudinal members such as member 92 which possesses ball 93 and socket 94. Members 92 interlink by said ball and socket arrangement to give a continuous flexible endless assembly which can be kept taunt by drums 84 and at the same time provide a seal in order to prevent air infiltration between members 92.

Making reference to FIGS. 1 and 2, dust collection system 27 generally comprises separator 95, fan 96, scrubber 97 and stack 98, fan 96 putting the whole system into a negative draft. By means of actuation of proper damper, this negative draft begins at evacuator 37, head 56, and chamber 65, thence to plenum 66 and through band 81 into duct 26 wherefrom the gases are pulled into separator 95 and forced into scrubber 97 and stack 98. Fan 96 can be relocated to be between scrubber 97 and stack 98. The fan is of such capacity that it can pull gases without any difficulty even though the distances can roughly be 500 or more feet from its location. Water from separator 95 and the scrubber 97 is directed to settling tank 99 by means of piping system 100 and 101 respectively. From separator 99 water is pumped through system 102 thence to piping system 107 and recirculated into trough 71 for re-use to quench coke during the push from oven 21. When the PH of the water in settling tank 99 reaches a certain level of acidity valve 103 is closed and 104 is open in order to divert acidic water to neutralizer 105 where it is neutralized by reaction with a base such as calcium hydroxide to precipitate a salt. The water leaves neutralizer 105 through system 106 and pumped to trough 71 through same piping system 107.

To correct the gas evolution from the flues by burning fuel with high sulphur content and to provide for leakage through the oven walls into the flues, these unburned and sulphur contaminated cases are diverted from the battery to waste gas duct 108 into afterburner 109 as shown in FIG. 2 instead of ejecting these gases through the stack of the battery which is not shown herein but which is the custom nowadays. These gases are fully burned in afterburner 109 and diverted by means of secondary duct 110 to make connection to duct 26. These gases having been fully burned are pulled through duct 26 and cleaned in dust collection system 27 which was described above. Afterburner 109 can be equipped with heat recovery system such as 111 to generate steam at a constant rate relatively.

In the art to which this invention pertains it is well known that there is leakage of gases through doors 23 during the coking cycle. Hood 112 along the length of the battery on both the pusher and the coke side is provided. Such hood is designed to have visor 113 to overhand in a canopy-like arrangement over each door of oven 21 to suck in the gases evolving. These gases being pulled through into hood 112 thence to a common 114 which common connects to duct 26 at the end of the battery. This arrangement makes possible for the same dust collection system to pull the gases for treatment before ejection, not only during charging, door extraction and quenching but also emissions during the coking cycle.

Miscellaneous platforms 115 including catwalks 116 and staircases 117 are provided to make the system accessible for maintenance and operation. Conveyor 88 at the bottom of chute 67 carries the quenched coke for storage without the necessity of the employment of a quenching car.

OPERATION

While the operation of the apparatus of the present invention may be comprehended from a study of the foregoing description, it is believed that the operation of this apparatus and the method itself may be further explained as hereinafter set forth.

Referring to FIGS. 1 and 4, assuming that the apparatus is to be initially started with oven 21 empty and ready to be charged and charging car 22 is aligned with oven 21 to discharge the coal from hoppers 33 through charging holes 30. Fan 96 which runs continuously puts manifold 43 in a negative draft when damper 51 is opened. Closure 47 is swung open and carriage 44 is propelled, telescoping section 52 moving towards oven 21, so that aperture 24 of oven 21 is in registry with the opening of manifold 43 to thus put oven 21 in a negative pressure.

When the coal is dropped from hoppers 33 through charging holes 30, the dust, smoke, water vapor and flames are sucked through aperture 24 into manifold 43 and an adequate supply of air is aspirated through louvers 48 to form a proper mixture. Ignitors 50 spark the mixture and fully burn the combustables. Diverter 53 directs the burnt gases to plenum 66 whence they enter duct 26 through junction 80 while water sprays 89 are activated to cool these gases before entry into separator 95. Manifold 43 remains in this position of evacuation until the complete charge is in the oven and the charging holes are covered and sealed and also until the leveling of the oven by the pusher (not shown) is completed. After the closing of the leveling door on the pusher side, carriage 44 of evacuator 37 is retracted and closure 47 closes aperture 24. At this point the damper of the stand-pipe leading to the byproduct collecting main (not shown) is open and the coking operation proceeds for about 16 hours. Having secured charging holes 30, the leveling door (not shown) and closure 47, the oven is fully sealed.

The gases evacuated during the charging of the coal as explained are pulled from the oven through aperture 24, mixed and burned in manifold 43, directed to plenum 66, cooled in duct 26, separated from heavy particles in separator 95, cleaned in scrubber 97 and ejected through stack 98.

Having completed the evacuation of gases during charging, evacuator-quencher 25 is in a position to travel to another oven by actuating travel drive 41, but in so doing drives 85 and 86 of band 81 are automatically actuated so that drums 87 operate clockwise or counter clockwise depending upon which direction evacuator-quencher 25 travels.

After the coal is heated for sixteen hours as mentioned, oven 21 is ready to be discharged or as known in the art "pushed". By means of drive 41, evacuator-quencher 25 moves along rails 29 and 35 so that door extractor 38 is in registry with oven 21 and by actuating mechanism 56 door 23 is extracted, damper 57 putting hood **56*a* in a negative pressure. The gases from the end of oven 21 are thus sucked into hood 56*a* in order to collect such gases, particularly this being important in the case of green coke smoke, so that such smoke is not emitted to the atmosphere. Such gases are diverted to plenum 66 whence they enter duct 26 and in turn pulled into separator 95 for cleaning as above described for the gases evacuated during charging. If necessary, these gases can be burned in hood 56*a*. Manifold 37, hood 56*a* and plenum 66 are made of heat resistant material to prevent warpage. It is common for door 23 to smoke after its removal from oven 21, provisions are made for the smoke from door 23 to be directed to hood 56*a*** for evacuation into the same system.

After the extraction of door 23, evacuator-quencher 25 by means of drive 41 travels to align guide 58 with oven 21 in a preparation for the push. Damper 68 is opened in order to put guide 58 in a negative pressure and by means of drive 61, guide 58 which is enclosed in chamber 65, is propelled towards oven 21 in such a manner that guide 58 circumscribes the opening of oven 21 on the coke side and thusly putting oven 21 in a negative pressure. At this point, operator of evacuator-quencher 25 in cab 40 signals the operator of the pusher (not shown) to extract the door on the pusher side and proceed with the push. Guide 58 is supported on rollers 59 at the bottom and rollers 60 on each side thereof at the top. This insures proper alignment of guide 58 with door opening of oven 21.

As the coke is pushed through guide 58, spray system 62 is activated and jets of water shoot from the sides, top and end of guide 58 through nozzles. It is preferred to turn on the various branches of the spraying system sequentially as the coke is being pushed through guide 58. Inasmuch as it is contemplated to have two systems of water, one for contaminated water and one for clean water, system 64 which handles the contaminated water is turned on first against the incandescent coke emerging from the door opening of oven 21 so that the ammonia, phenol, hydrogen sulfide, cyanide, etc., are incinerated and broken up to their basic elements and thusly making a practical disposition of contaminated water possible. The great surface exposure of the coke to the multitude of sprays as the coke is being pushed offers an efficient manner of quenching and makes possible for the operation to be concurrent with the push so that the coke leaving the guide falls into chute 67 and thence to conveyor 88, thereby eliminating the necessity of the extra operation of transporting the hot coke in a quench car to the quenching tower. As the coke tends to slump in the guide and open up a cleavage or central opening, sprays are directed into the emerging end of the guide so that water sprays penetrate the cleavage to make the quenching still more efficient. This is shown by FIG. 12 with sprays 63 on the sides and top of the coke while sprays 75 spraying into the emerging end with the cleavage being shown by numeral 73. During the quenching operation water is withdrawn from troughs 71 and 72 using the snorkel and suction principle by the actuation of pump 62. During the pushing of the coke through the guide the atmosphere of the guide is maintained substantially non-oxidizing. According to the preferred embodiment the non-oxidizing atmosphere is provided by chamber 65.

As the steam and gases are generated while the coke is being quenched, they are sucked into chamber 65 and rise into plenum 66 whence they are diverted into duct 26 through opening 83. The steam and gases from duct 23 are pulled into separator 95 and thence to scrubber 97. Chamber 65, plenum 66, and duct 26 are so designed to handle all the steam and gases generated during quenching. As the coke is being pushed through guide 58, the quenching continues and the gases are collected and treated. At the end of the push the sprays are sequentially turned off to eliminate excessive water consumption. Any excess water used during quenching is collected in sump 77 which is recirculated. Once all the coke leaves guide 58 at the end of the push, guide 58 is retracted away from door opening of oven 21 and evacuator-quencher 25 travels on rails 29 and 35 so that door 23 is placed in position by door extractor 38, and thusly close the end of oven 21 on the coke side. The pusher (not shown) closes the opening of oven 21 on the pusher side.

During the travel of evacuator-quencher 25, band 81 is moved at the same speed and in the same direction as evacuator-quencher 25 in order to stay in a fixed relationship with band 81. As described, this is accomplished by actuating drives 85 and 86 to wind drums 87 clock-wise or counter clock-wise depending upon the direction of travel of evacuator-quencher 25 and thereby maintain the same speed and direction as the speed and direction of evacuator-quencher 25 in order to eliminate connecting and disconnecting plenum 66 to duct 26, everytime evacuator-quencher 25 travels on wheels 42.

Water from the separator and scrubber are diverted to settling tank 99 whence the water is recirculated into trough 71 or 72. Once the acidity of the water reaches a certain PH it is automatically diverted to neutralizer 105 for further concentration to make an acid such as sulfurous or sulfuric acid which result from the sulfur dioxide caused by the incineration of hydrogen sulfide in the guide. The acidity of this solution can be neutralized by reaction with calcium hydroxide to precipate a salt and recirculating the water after precipitation.

During the coking cycle in the ovens of battery 20, flue gases resulting from combustion or from leakage through oven walls are diverted into afterburn 109 instead of ejecting them through the battery stack (not shown) into the atmosphere. These gases after being fully burned, are diverted into duct 26 by means of secondary duct 110 for treatment in dust collection system 27. Also gases are collected on both sides of the battery caused by door leakage and diverted into dust collection system 27 by means of duct 114. For proper flow of water and condensing steam, duct 26 is provided with a declining bottom. Also, since contaminated water is corrosive, an extensive part of the system is made of corrosion resistant material such as stainless steel.

In conclusion, by providing a suitable negative draft of high enough capacity in dust collection system 27 by providing a common duct such as duct 26 to which all emissions are directed and by providing evacuator-quencher 25, all pollutant gases caused by charging of coal, pushing of coke, quenching of coke, burning of fuel in the flues, leakage in the flues and leakage through doors, a composite solution adapted to fit any existing battery is made possible, such solution being easily maintainable and being acceptable to health boards. Numerous other advantages are obtained as aforementioned in the objects of this specification. All in all it is submitted that the present invention provides an improved method in by-product coke oven operation and apparatus for accomplishing same capable of collecting and treating emissions and dropping the temperature of coke below its ignition point as it is being pushed and by taking advantage of the offimity of the hot coke to the high rate of water absorbtion and the creation of steam which steam by virtue of evaporation causes a negative draft at all points of entry including chamber 65, junction 80 and band 81.

I claim:

1. Apparatus for making coke including a battery of ovens having adjacent pusher sides and adjacent coke discharge sides, a quenching chamber having an inlet portion adapted to be located adjacent the discharge side of any of said ovens, means for quenching the coke as it is being pushed into said quenching chamber, a traveling evacuator means adapted to move along said battery of ovens on their coke discharge sides and to be positioned adjacent the coke discharge side of a selected oven, said evacuator means being adapted to extract gases from the discharge side of any of said ovens during charging of that oven, said evacuating means also being adapted to extract gases from said chamber as the coke is quenched therein, a duct running along the length of said battery having an open top which is covered by a band in the form of a conveyor belt, a fixed connection between said duct and said evacuator, said band having drive means to move said band linearly in the same direction and at substantially the same speed as said traveling evacuator means, the linear motion of said band being dictated by the motion of said evacuator means.

2. Apparatus as set forth in claim 1, wherein the discharge side of each oven includes a door mechanism, means for removing the door of any of said ovens, a hood for collecting gases during door removal, said evacuator means including a plenum which is fixedly connected to said duct.

3. Apparatus as set forth in claim 1 wherein said band comprises a plurality of sections tied together by ball and socket joints.

4. Apparatus as set forth in claim 3 wherein the coke discharge side of each coke oven includes a first door mechanism which may be moved to permit discharge of coke, a second door mechanism carried by said first door mechanism and moveable relative to said first door mechanism to provide a discharge port at the coke discharge side of each oven, means for moving said second door of an oven relative to its first door when said traveling evacuator means is positioned adjacent said oven so that charging gases may be evacuated through the said port on the coke discharge side of said oven.

5. A method of abating smoke during the pushing of coke from a coke oven having a pusher side and a coke discharge opening, said method comprising the steps of providing a guide having an inlet portion and an outlet portion, placing the inlet portion of said guide in alignment with the coke oven discharge opening, applying force against the pusher side of a hot body of coke to push the hot coke from the oven through said guide, cooling the hot body of coke while it is at least partially within the guide and moving through the guide under the influence of the force applied against the pusher side of the hot body of coke by directing fluid toward the coke within the guide during the pushing of the coke through the guide, quenching a face of the hot body of coke frontally and centrally in a direction opposite pushing as it is being pushed through the guide, and during said pushing step maintaining the atmosphere of said guide substantially non-oxidizing.

6. A method of abating smoke during the pushing of coke from a coke oven having a pusher side and a coke discharge opening, said method comprising the steps of providing a guide having an inlet portion and an outlet portion, placing the inlet portion of said guide in alignment with the coke oven discharge opening, applying force against the pusher side of a hot body of coke to push the hot coke from the oven through said guide, cooling the hot body of coke while it is at least partially within the guide and moving through the guide under the influence of the force applied against the pusher side of the hot body of coke by directing liquid toward the coke within the guide during the pushing of the coke through the guide and comprising the step of directing liquid at a face of the hot body of coke frontally and centrally in a direction opposite pushing as it is being pushed through the guide, and during said pushing step maintaining the atmosphere of the guide substantially non-oxidizing.

7. A method as set forth in claim 5 and further including the step of providing a chamber, collecting at least some of the gases generated by the cooling of the coke in the chamber, and evacuating collected gases from the chamber.

8. A method as set forth in claim 5 wherein there is provided a conveying means which is exposed to atmosphere adjacent the outlet portion of said guide, the step of pushing the coke through the guide including the step of pushing the coke through the guide and onto the conveying means.

9. A method as set forth in claim 8 wherein said conveying means comprises a belt conveyor, and wherein the step of pushing the coke through the guide and onto the belt conveyor is followed by the step of conveying the coke to a storage location.

10. The invention as set forth in claim 5 wherein the step of directing water toward the coke includes the step of directing contaminated fluid toward the coke to break up the chemicals contaminating the water into their basic elements.

11. A method as set forth by claim 10 including the further steps of collecting at least some of the gases generated by the cooling of the coke, and treating the collected gases.

12. The invention as set forth in claim 5 wherein the step of directing fluid toward the coke comprises the step of directing liquid toward the coke and wherein there is further provided the step of collecting the liquid used to cool the coke and treating it to neutralize its acidity when it exceeds a predetermined degree of acidity.

13. A method as set forth in claim 5 wherein the step of cooling the coke further includes the step of providing a series of liquid spraying stations for directing liquid at the sides of the moving body of coke, and progressively stopping the directing of liquid at the sides of the body of coke by a liquid spraying station after the coke body has passed the liquid spraying station.

14. A method as set forth in claim 7 wherein the step of cooling the coke as it moves through the guide comprises the step of directing liquid at a face of the hot body of coke frontally and centrally and in a direction opposite pushing from a location outside of the confines of the guide.

15. A method of abating smoke during the pushing of coke from a coke oven having a pusher side and a coke discharge opening, said method comprising the steps of providing a guide having an inlet portion including an inlet opening and an outlet portion, placing the inlet portion of said guide in alignment with the coke oven discharge opening, applying force against the pusher side of a hot body of coke to push the hot coke forwardly from the oven through said guide, cooling the hot body of coke while it is at least partially within the guide and moving through the guide under the influence of the force applied against the pusher side of the hot body of coke by directing liquid toward the coke within the guide during the pushing of the coke through the guide including the steps of directing liquid from directions substantially transverse to the direction of pushing the coke and directing liquid at the coke from a location which is forward of and substantially central of the inlet portion of the guide and which is frontal with respect to the inlet opening so as to direct liquid substantially frontally into the central opening which is formed as the coke is being pushed through the guide under the influence of the pusher, and during said pushing step maintaining the atmosphere of the guide substantially non-oxidizing.

16. Apparatus for abating smoke during the pushing of coke form a coke oven having a pusher side and a coke discharge opening, comprising a guide having an inlet portion and an outlet portion, said guide having a pair of side portions defining a central portion therebetween, the width of said central portion being at least as great as the width of the coke discharge opening of said coke oven so that when the inlet portion of said guide is located in alignment with the coke oven discharge opening a hot body of coke which is pushed from the oven is pushed through the central portion of said guide, means for cooling the hot body of coke while it is at least partially within the guide and being pushed through the guide comprising means for directing liquid at the hot body of coke as it is being pushed through the guide, said means for directing liquid at the hot body of coke being located frontally of the inlet portion of the guide and aligned with the central portion defined between the side portions of the guide to direct liquid substantially into the frontal and central portion of the hot body of coke as the coke is being pushed through the guide, and means for maintaining the atmosphere of the guide substantially non-oxidizing as the coke is being pushed through the guide.

17. Apparatus as set forth in claim 16 including a chamber surrounding the guide including means for maintaining the atmosphere of said guide substantially non-oxidizing during the pushing of the coke and means for collecting at least some of the gases generating during the cooling of the coke.

18. Apparatus as set forth in claim 17 and including means for evacuating collected gases from said chamber.

19. Apparatus as set forth in claim 18 including means for transporting said chamber along a battery of coke ovens, and means for permanently connecting said chamber with said evacuation means during the transporting of said chamber.

20. Apparatus as set forth in claim 19 wherein said evacuation means comprises a duct, and said means for permanently connecting said chamber with said duct comprises a belt fixedly connected to said chamber and movable therewith, said belt having a first surface exposed to the interior of the chamber and a second surface exposed to the interior of the duct, fluid passage means between the first surface and the second surface of the belt.

21. Apparatus as set forth in claim 16 wherein said means for directing liquid at the hot body of coke is also located frontally of the outlet portion of said guide.

22. Apparatus as set forth in claim 16 wherein said means for cooling the coke include a plurality of nozzles disposed so as to direct liquid in a direction substantially normal to said inlet opening.

23. Apparatus for abating smoke during the pushing of coke from a coke oven having a pusher side and a coke discharge opening, comprising a guide having an inlet portion and outlet portion and a pair of side portions defining a central portion therebetween, means for locating said inlet portion of said guide in alignment with the coke oven discharge opening so that a hot body of coke which is pushed from the oven is pushed through said guide, means for cooling the hot body of coke while it is at least partially within the guide and being pushed through the guide comprising means for frontally and centrally cooling a face of the coke as it moves through the guide, said means for frontally and centrally cooling a face of the coke comprising liquid dispensing means supported in a position which is located frontally of the inlet portion of the guide and which is substantially centrally of the side portions of the guide and disposed so as to direct liquid in a direction which is substantially opposite the direction of pushing to direct liquid substantially into a central portion of the hot body of coke as the coke is being pushed through the guide, and means for maintaining the atmosphere of the guide substantially non-oxidizing as the coke is being pushed through the guide.

* * * * *

UNITED STATES PATENT OFFICE

CERTIFICATE OF CORRECTION

Patent No. 3,972,780 Dated August 3, 1976

Inventor(s) Albert Calderon

It is certified that error appears in the above-identified patent and that said Letters Patent are hereby corrected as shown below:

Column 12, line 32 change "3" to --1--.

Column 13, line 30 change "water" to --fluid--.

Column 13, line 31 change "fluid" to --water--.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*